US009919899B2

(12) United States Patent
Husmann

(10) Patent No.: US 9,919,899 B2
(45) Date of Patent: Mar. 20, 2018

(54) ACTUATION OF A SAFETY BRAKE

(71) Applicant: Inventio AG, Hergiswil (CH)

(72) Inventor: Josef Husmann, Lucerne (CH)

(73) Assignee: INVENTIO AG, Hergiswil (CH)

( * ) Notice: Subject to any disclaimer, the term of this patent is extended or adjusted under 35 U.S.C. 154(b) by 765 days.

(21) Appl. No.: 14/362,441

(22) PCT Filed: Nov. 27, 2012

(86) PCT No.: PCT/EP2012/073674

§ 371 (c)(1),
(2) Date: Jun. 3, 2014

(87) PCT Pub. No.: WO2013/083430

PCT Pub. Date: Jun. 13, 2013

(65) Prior Publication Data

US 2014/0332324 A1 Nov. 13, 2014

(30) Foreign Application Priority Data

Dec. 9, 2011 (EP) ..... 11192831

(51) Int. Cl.
*B66B 5/18* (2006.01)
*B66B 5/20* (2006.01)
*B66B 5/24* (2006.01)

(52) U.S. Cl.
CPC ..... *B66B 5/24* (2013.01); *B66B 5/18* (2013.01); *B66B 5/20* (2013.01)

(58) Field of Classification Search
CPC ..... B66B 5/20; B66B 5/18
See application file for complete search history.

(56) References Cited

U.S. PATENT DOCUMENTS 6,092,630 A * 7/2000 Wendel ..... B66B 5/18 187/373
6,176,350 B1 * 1/2001 Schlosser ..... B66B 5/20 187/359
6,758,310 B2 * 7/2004 Muff ..... B66B 5/22 187/368

(Continued)

FOREIGN PATENT DOCUMENTS

CN 1491879 A 4/2004
CN 101605713 A 12/2009

(Continued)

*Primary Examiner* — William A. Rivera
*Assistant Examiner* — Stefan Kruer
(74) *Attorney, Agent, or Firm* — William J. Clemens; Shumaker, Loop & Kendrick LLP

(57) ABSTRACT

An elevator car has a brake system with braking devices engaging braking webs integrated into guide rails to brake the car. The braking devices include a brake housing, a first brake body movable by contact with the braking web and relative movement between the braking web and the brake housing to clamp the brake web, and a pusher arranged on the brake housing with the braking web arranged between the first brake body and the pusher with a required passage clearance. The pusher can be advanced toward the first brake body and pressed against the braking web to forcibly bring the first brake body into contact with the braking web. A pressing lever pivotally mounted on the brake housing acts to press the pusher against the braking web.

13 Claims, 7 Drawing Sheets

(56) References Cited

U.S. PATENT DOCUMENTS

| | | | | |
|---|---|---|---|---|
| 7,097,003 | B2 * | 8/2006 | Reynolds | B66B 13/06 187/351 |
| 8,186,483 | B2 * | 5/2012 | Sirigu | B66B 5/22 187/288 |
| 2004/0112683 | A1 | 6/2004 | Liebetrau et al. | |
| 2007/0007083 | A1 * | 1/2007 | Husmann | B66B 5/20 187/366 |
| 2009/0133964 | A1 | 5/2009 | Ueda et al. | |
| 2011/0226560 | A1 | 9/2011 | Husmann | |
| 2013/0248298 | A1 * | 9/2013 | Osmanbasic | B66B 5/20 187/359 |
| 2016/0355377 | A1 * | 12/2016 | Husmann | B66B 5/18 |

FOREIGN PATENT DOCUMENTS

| | | | | |
|---|---|---|---|---|
| EP | 2112116 | A1 | 10/2009 | |
| JP | 2010265068 | A | 11/2010 | |
| WO | WO 2008057116 | A1 * | 5/2008 | B66B 5/22 |

* cited by examiner 2 elevator car
3 counterweight
5 drive
8 guide shoe
10 elevator control
11 brake control
12 shaft door
15 actuator
20, 20' safety brake or elevator braking device

A – A

A – A

A – A

A – A

A – A

ACTUATION OF A SAFETY BRAKE

FIELD

The invention relates to a method of braking a travel body of an elevator installation and to a corresponding elevator braking device.

BACKGROUND

The elevator installation is installed in a building. It substantially consists of a car, which is connected by way of support means with a counterweight or with a second car. The car is moved along substantially vertical guide rails by means of a drive which selectably acts on the support means or directly on the car or the counterweight. The elevator installation is used in order to convey persons and goods within the building over individual or several floors.

The elevator installation includes devices in order to safeguard the elevator car in the case of failure of the drive or of the support means. For that purpose, use is usually made of safety brakes which when required can brake the elevator car on the guide rails.

A safety brake of that kind is known from European Application EP 2112116, which can be triggered by way of an electromechanical device. In that case, an electromagnet holds a brake counterplate in a normal position against the action of a spring force. The electromagnet requires a large amount of energy, since it has to constantly operate with a high retention energy against the spring force.

SUMMARY

The invention has the object of providing an alternative safety brake which can be triggered by way of an electromechanical device and which can operate with a small amount of energy.

The safety brake, termed elevator braking device in the following, is provided for operation and for possible braking of an elevator car on a braking web, preferably on a braking web integrated in a guide rail. The elevator braking device includes a brake housing. The brake housing forms the basic structure of the elevator braking device. It is preferably incorporated in a support structure of an elevator car and it is preferably constructed for transmitting braking forces from brake bodies to the elevator car. Instead of the elevator car, the elevator braking device can obviously also be mounted on a counterweight of the elevator installation.

The elevator braking device includes a first brake body. This first brake body is arranged at the brake housing to be movable. It is constructed in such a manner that as soon as it comes into contact with the braking web and this braking web moves relative to the elevator braking device, thus when the elevator car moves along the guide rail, it moves in the brake housing with the braking web of the guide rail. Through this movement, which preferably takes place due to friction couple, the braking web can be clamped and the brake housing, or spring elements belonging to the brake housing, can be strained.

This takes place in that, for example, the first brake body includes or is a braking eccentric, which is arranged to be rotatable about an axis of rotation arranged at the brake housing. As soon as the eccentric is brought into contact with the braking web the eccentric is rotated by the friction force produced between eccentric and braking web. The brake housing is thereby urged back in correspondence with the eccentricity of the eccentric and the brake housing is correspondingly strained. In correspondence with the shape of the straining eccentric or of the braking eccentric the rotation thereof constrainedly takes place in correspondence with a direction of movement of the elevator braking device. The elevator braking device can consequently be constructed to act at both sides.

Alternatively, the first brake body can also be a brake wedge instead of an eccentric. In that case, a brake wedge is mounted on a wedge track at a spacing from the braking web. As soon as the brake wedge is brought into contact with the braking web or is pressed thereagainst the brake wedge is entrained by the friction force produced between brake wedge and braking web. The brake housing is thereby urged back in correspondence with the wedge slope of the brake wedge and brake housing is correspondingly strained.

The elevator braking device includes a presser. This presser is arranged at the brake housing so that the braking web can be arranged between the first brake body and the presser. The presser is thus disposed on a side, which is opposite the first brake body with respect to the braking web, in the brake housing. The presser is so arranged that in a normal setting there is, between the first brake body and the presser, a spacing at least corresponding with the thickness of the braking web plus a required passage tolerance between the first brake body, the braking web and the presser. The presser is so constructed that when required it can be adjusted in the direction of the first brake body substantially in a line of action extending perpendicularly to the braking web and that it can be pressed against the braking web able to be arranged between the first brake body and the presser. Moreover, the first brake body can be brought by a counterforce, which is produced by the pressing of the presser against the braking web, into contact with the braking web in that the presser arranged at the brake housing presses the brake housing laterally away and thus brings the first brake body, which is similarly arranged at the brake housing, into contact with the braking web. This form of clamping has the effect that the first brake body, after it has been brought into contact with the braking web, can be automatically strained again and thus bring the elevator braking device into action. The spacing between the first brake body and the presser can on occasion also be selected to be somewhat greater than the minimum required passage tolerance if, for example, other braking parts are intended for the presser.

Advantageously, the brake housing is fastened to the elevator car to be horizontally flexible or displaceable. The brake housing and thus the elevator braking device can thus be oriented with respect to the braking web, and guide shoes of the car are thereby relieved of load.

Advantageously, the elevator braking device further includes a pressing lever, which is pivotably mounted at the brake housing and which when required acts on the presser in order to press this against the braking web and to bring the first brake body into contact with the braking web. The trigger structure is thus directly located on the brake housing. This is advantageous, since the pressing forces are thus accepted directly within the elevator braking device. Type approvals of the elevator braking device, such as are frequently carried out by safety bodies, can thus be carried out simply for the individual subassembly, in the elevator braking device, since all functional parts are included in this one subassembly.

Advantageously, the elevator braking device includes a second brake body, which is similarly arranged at the brake housing so that the braking web can be arranged between the first brake body and the second brake body. In addition, the second brake body is so arranged that the straining, which can be produced by the first brake body, of the brake housing can clamp the braking web between the first and second brake bodies. Accordingly, the first brake body is, as a reaction to the pressed presser, drawn or pressed with respect to the braking web. The braking web is thus clamped. Straining of the brake housing takes place through subsequent straining of the first brake body, whereby the second brake body is clamped again.

Advantageously, the presser is at the same time the second brake body. This second brake body is mounted, partially slidably, in the brake housing by way of stop pins and supported by way of biased pressure elements, such as, for example, a plate spring packet, at the brake housing. The second brake body can consequently be adjusted by means of an adjusting device over the slide range of the stop pin towards the braking web and the first brake body can be drawn towards the opposite side of the braking web as a reaction. The braking web is thereby clamped and the first brake body entrained by a possible car movement. Through the straining function of the first brake body the presser or, in the present variant, the second brake body is initially urged back and strained again after contact with the pressing elements in the brake housing.

In an alternative, the presser is a stud. The stud is mounted at the brake housing or at the second brake body and it is adjustable towards the braking web, preferably by means of the pressing lever. In this embodiment the stud can be adjusted by means of the adjusting device towards the braking web and the first brake body can as a reaction be drawn towards the opposite side of the braking web. The braking web is thereby clamped and the first brake body is entrained by a possible car movement. Through the straining function of the first brake body the presser or, in the present variant, the stud is urged back until a plane of the second brake body is reached. The elevator braking device is thereafter strained again. In this embodiment the presser or the stud set back with respect to the second brake body, in the normal position, by a small amount.

In an alternative, the presser is a pressing roller. The pressing roller is preferably mounted on the brake housing. It is adjustable towards the braking web preferably by means of the pressing lever. In this embodiment the pressing roller is adjusted towards the braking web by means of the adjusting device and the first brake body is drawn towards the opposite side of the braking web as a reaction. The braking web is thereby clamped and the first brake body is entrained by a possible car movement. Due to the straining function of the first brake body the presser or, in the present variant, the pressing roller is urged back until a plane of the second brake body is reached. Thereafter, the elevator braking device is strained again.

Advantageously, the first brake body is realized in the form of a straining eccentric. The straining eccentric is arranged to be rotatable about an axis of rotation arranged at the brake housing. When the straining eccentric is pressed against the braking web the straining eccentric is rotated by a friction force produced between straining eccentric and braking web. The brake housing is thereby urged back and strained. Straining eccentrics are proven components and allow realization of the required adjusting and resetting travels.

The straining eccentric is advantageously centered in the normal position by resetting means. Departure from the normal position, attainment of a predetermined clamping and/or attainment of a braking setting is or are ascertained by an electrical sensor. The resetting means is preferably a spring-loaded roller tappet which co-operates with a control cam, which is mounted at the straining eccentric, or a resetting cam. The sensor monitors, for preference, the position of the roller tappet. This is advantageous, since the working setting of the elevator braking device can be monitored. The elevator installation can thus, for example, be stopped as long as the elevator braking device is in its braking setting or as long as it is in a significant clamping range. A significant clamping is, for example, achieved when the straining eccentric is significantly rotated or the resetting means is correspondingly clearly pressed.

Advantageously, an elevator braking device of that kind is attached to the elevator car of the elevator installation by way of a horizontal slide device and a centering device. The brake housing and thus the elevator braking device can therefore be oriented with respect to the braking web and guide shoes of the car are thereby relieved of load. The centering device advantageously comprises a double arrangement of springs or abutments, which resiliently hold the brake housing in a center position. This centering device is set at the time of installing the elevator installation or at the time of maintenance thereof.

Advantageously, the presser of the elevator braking device can, when required, be pressed against the braking web by means of an actuator loaded by a biased spring. An adjusting mechanism of the elevator braking device, such as presser, pressing lever, studs and rollers, is thus relieved of load in normal operation. The parts loaded with force in normal operation are thus concentrated in a preferably separate actuator.

Advantageously, in each instance at least two elevator braking devices are attached to an elevator car and respectively act as required on braking webs or guide rails arranged on either side of the elevator car. Forces of the elevator braking devices can thus be introduced into the elevator car symmetrically and an actuator can act directly synchronously on the two adjusting mechanisms of the elevator braking devices.

DESCRIPTION OF THE DRAWINGS

Exemplifying embodiments are explained in the following by way of examples and schematic illustrations, in which.

The same reference numerals are used in the figures for equivalent parts over all figures.

DETAILED DESCRIPTION

Figure 1:
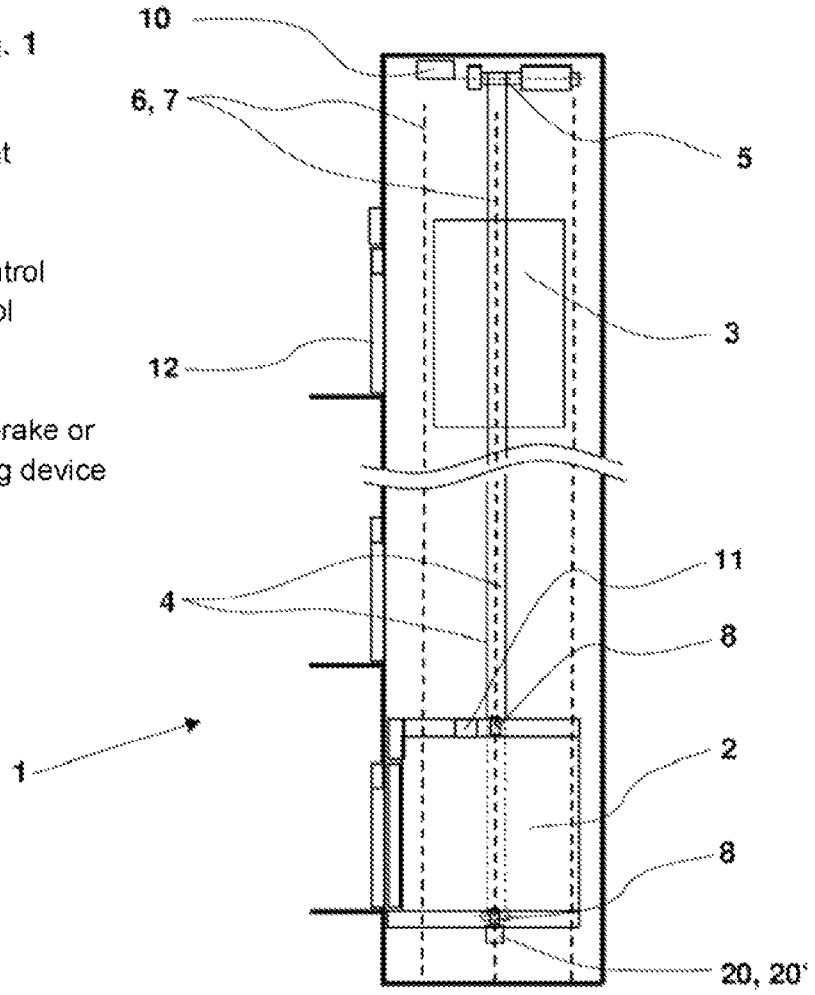
FIG. 1 shows a schematic view of an elevator installation in side view.

FIG. 1 shows an elevator installation 1 in an overall view. The elevator installation 1 is installed in a building and it serves for the transport of persons or goods within the building. The elevator installation includes an elevator car 2, which can move upwardly and downwardly along guide rail 6. The elevator car 2 is for that purpose provided with guide shoes 8 which guide the elevator car as accurately as possible along a predetermined travel path. The elevator car 2 is accessible from the building by way of shaft doors 12. A drive 5 serves for driving and holding the elevator car 2. The drive 5 is arranged in, for example, the upper region of the building and the car 2 is suspended from the drive 5 by support means, for example support cables or support belts. The support means 4 are guided by way of the drive 5 to a counterweight 3. The counterweight provides balance for a mass component of the elevator car 2 so that the drive 5 with respect to the mains axis merely has to provide compensation for an imbalance between car 2 and counterweight 3. In the example, the drive 5 is arranged in the upper region of the building. It could obviously also be arranged at a different location in the building or in the region of the car or the counterweight.

The elevator installation 1 is controlled by an elevator control 10. The elevator control 10 receives user requests, optimizes the operating sequence of the elevator installation and controls the drive 5.

The elevator car 2 and, if required, also the counterweight 3 are additionally equipped with a braking system, which is suitable for securing and/or retarding the elevator car 2 in the case of unexpected movement or in the case of excess speed. In the example, the braking system comprises two constructionally identical safety brakes or elevator braking devices 20, 20', which are installed at the travel body 2, 3 on either side thereof. The elevator braking devices 20, 20' are, in the example, arranged below the car 2 and are electrically, actuable by way of a brake control 11. This brake control 11 preferably also includes an electronic speed or travel plot limiter, which monitors travel movements of the elevator car 2. A mechanical speed limiter, such as is usually used, can accordingly be eliminated.

Figure 2:
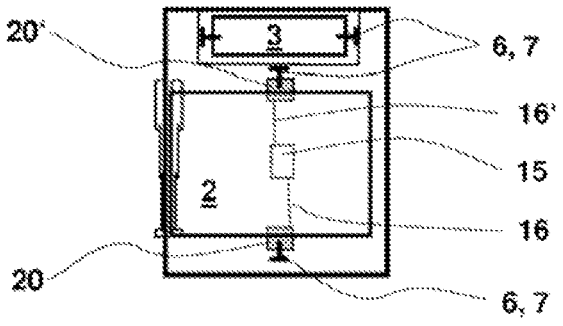
FIG. 2 shows a schematic view of the elevator installation in cross-section.
Figure 3:
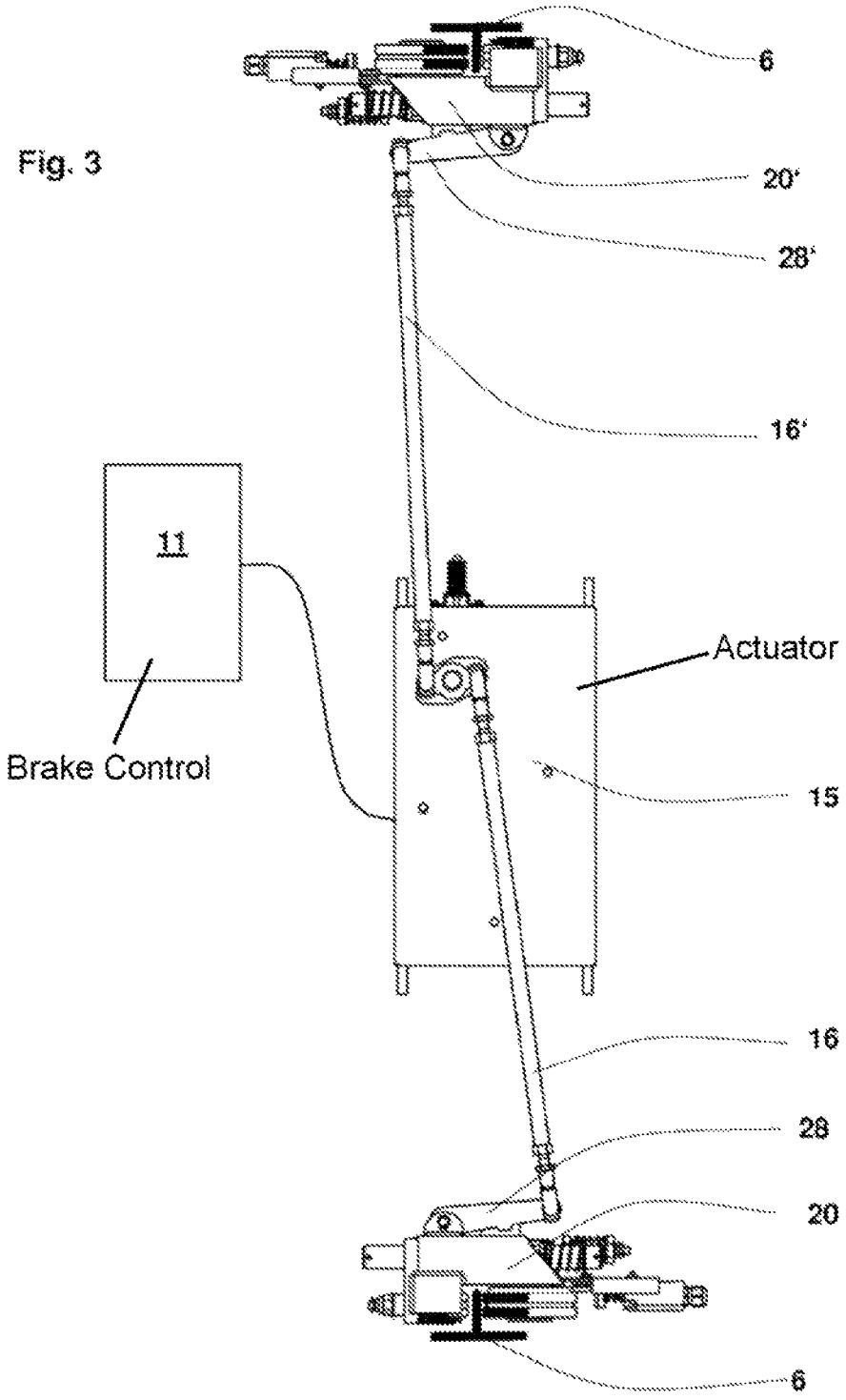
FIG. 3 shows an arrangement with two elevator braking devices and actuators.

FIG. 2 shows the elevator installation of FIG. 1 in a schematic plan view. The braking system includes the two elevator braking devices 20, 20'. The two elevator braking devices 20, 20' are, as illustrated in detail in FIG. 3, coupled to an actuator 15 by way of connecting rods 16, 16' so that the two elevator braking devices 20, 20' can be constrainedly actuated together. Unintended braking at one side can thus be avoided and the two elevator braking devices 20, 20' are actuable in simple manner by way of the common actuating unit 15, which is activated by the brake control 11. The two elevator braking devices 20, 20' are preferably executed to be constructionally identical or in mirror symmetry and act on the brake rail 7 arranged at the two sides of the car 2. In the detail explanations with respect to the elevator braking device only one elevator braking device 20 is discussed in the following, but the left-hand and right-hand elevator braking devices are always signified. In the example, the brake rails 7 are identical with the guide rails 6.

The construction and function of the elevator braking device 20 are explained by way of example in the following on the basis of the series of FIGS. 4 to 7. The index "a" with respect to the figure numbers in each instance denotes a sectional view from above. A brake housing 21 of the elevator braking device 20 is fastened to the support structure of the elevator car 2 by means of a slide device 35 (FIG. 4*a*). The slide device 35, for example slide rods, makes it possible for the brake housing 21 to be mounted to be laterally slidable relative to the car 2 and enables introduction of vertical braking forces into the car. The brake housing 21 is supported laterally with respect to the car by a centering device 34. The centering device 34 is equipped with springs 34' (see FIG. 6*a*) and abutments 33.1, 33.2, which permit lateral displacement of the brake housing to both sides by low forces, but which in the absence of external lateral forces reset the brake housing into a settable center position. Instead of abutments 33.1, 33.2 use can also be made, for example, of lateral bending rods which reset the brake housing each time into the center position.

A first brake body 22 is arranged at the brake housing 21. In the example, the first brake body is a straining eccentric 23. The first brake body 22 or the straining eccentric 23 is mounted to be rotatable about an axis 24 of rotation, which is fixedly arranged in the brake housing. The first brake body 22 is shaped in such a manner that a spacing of the straining eccentric 23 from the axis 24 of rotation continuously increases starting from a zero position over an angle of rotation. In end regions, the straining eccentric 23 goes over into a brake surface. The first brake body 22 is positioned in the zero position by a resetting means 37. In the example, the first brake body 22 includes for that purpose a resetting cam 40 which is rotatable together with the first brake body 22. The resetting cam 40 is flattened in the region of the zero position and a roller tappet 38 constantly presses against the resetting cam 40. The roller tappet 38 is loaded by a tappet spring 39 so that the roller tappet 38 always presses against the resetting cam 40. A corresponding resetting moment of the first brake body 22 takes place due to this pressing against the resetting cam 40 flattened in the region of the zero position. The course of the resetting moment can be influenced by the shape of the resetting cam 40 with valleys and elevations. In the example, the roller tappet 38 is a spring-loaded roller lever. The roller tappet can instead also be a direct, longitudinally spring-loaded tappet.

In the example, the position of the first brake body 22 is detected by means of the position of the roller tappet 38 by way of a sensor 36, for example a safety switch, since a rotated first brake body 22 urges the roller tappet rearwardly and activates the sensor 36.

In addition, a presser 25 is arranged at the brake housing 21, which in the example is welded together from a plurality of parts. In the example, the presser 25 is constructed in accordance with FIGS. 4 to 7 as a stud 26. The stud 26 is assembled together with a second brake body 30. The second brake body 30 includes a brake part 30.1 which is supported in the brake housing 21 by way of pressure elements 31. The stud 26 is guided in the brake part 30.1 by means of a bore, so that it is movable through the brake part 30.1.

A spacing S1 is set between the first brake body 22 and the second brake body 30. This spacing S1 enables arrangement of guide rails 6 or a braking web 7 in this intermediate space. The spacing S1 can be set by the design and setting of the pressure elements 31 and the associated stop pin 32. The spacing S1 is usually set so that it corresponds with the thickness S3 of the braking web 7 of the guide rail 6 plus a desired passage play S2 between braking web 7 and brake surfaces of the first and second brake bodies 22, 30. Typical passage plays S3 are approximately 1.5 to 3.5 millimeters.

Figure 4:
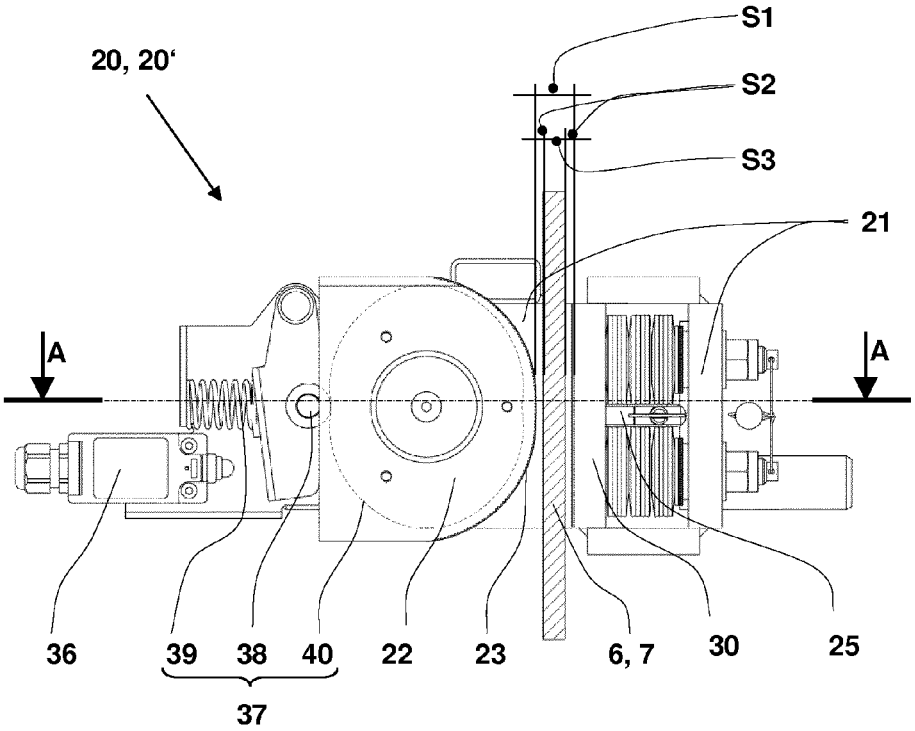
FIG. 4 shows a view of an elevator braking device in a normal setting.
Figure 4A:
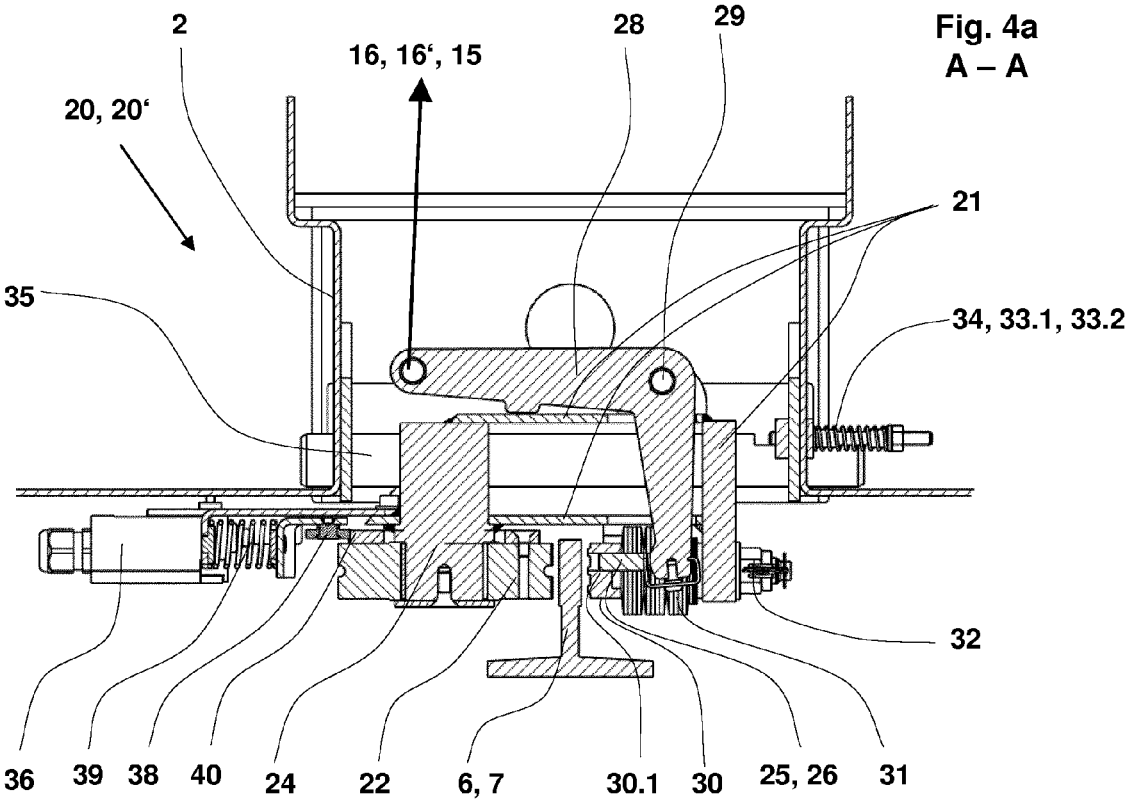
FIG. 4*a* shows a sectional illustration of the elevator braking device of FIG. 4.

In the example of FIGS. 4 and 4*a* in the normal setting or the normal position of the elevator braking device 20 the stud 26 is set so that it is set back by a small amount behind a brake surface of the second brake body 30 or the brake part 30.1. Thus, in the normal setting the spacing S1 between the first brake body 22 and the presser 25, or the stud 26, corresponds at least with the thickness of the braking web S3 plus the passage play S2 required between the first brake body 22, the braking web 7 and the presser 25.

The stud 26 is connected with a pressing lever 28 and the pressing lever 28 is arranged in the brake housing 21 to be pivotable about a fulcrum 29. The pressing lever 28 is additionally connected with the actuator 15 by way of connecting rods 16, 16'.

In the normal setting according to FIGS. 4 and 4*a* the pressing lever 28, which is substantially free of force, is in the normal setting. At least the spacing S1 is set between presser 25 and first brake body. The first brake body 22 is held by the resetting means 37 in the zero position and the sensor 36 does not detect a braking state. In this normal setting the elevator car together with the attached elevator braking device 20 can move freely.

Figure 5:
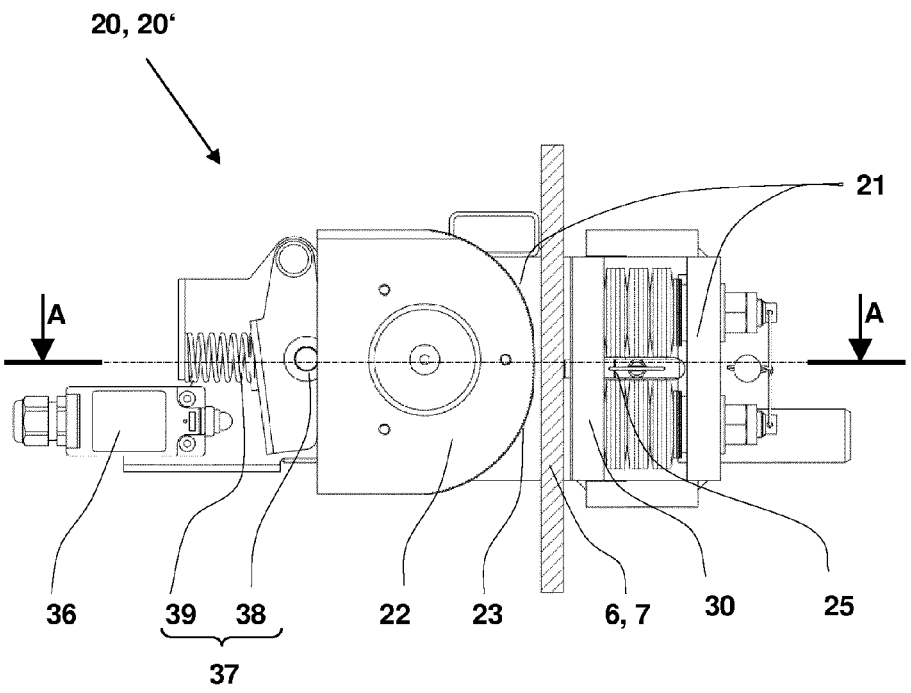
FIG. 5 shows a view of an elevator braking device in a pressing setting.
Figure 5A:
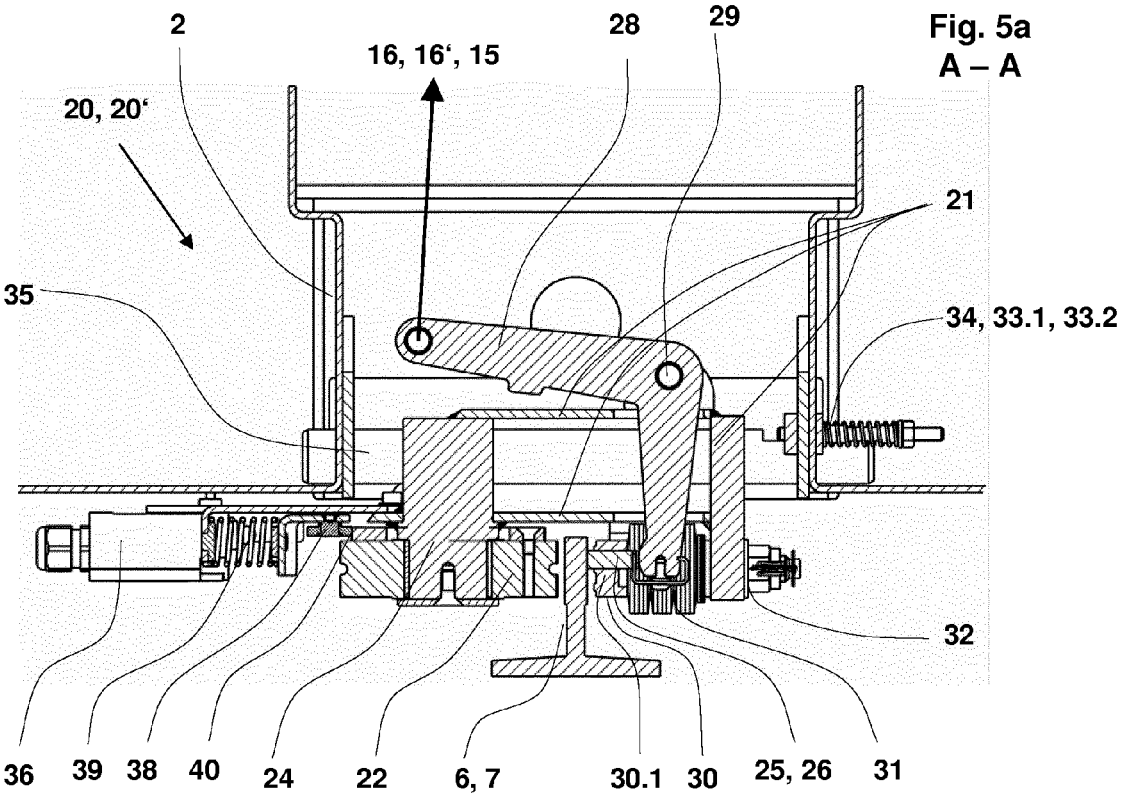
FIG. 5*a* shows a sectional illustration of the elevator braking device of FIG. 5.
Figure 6:
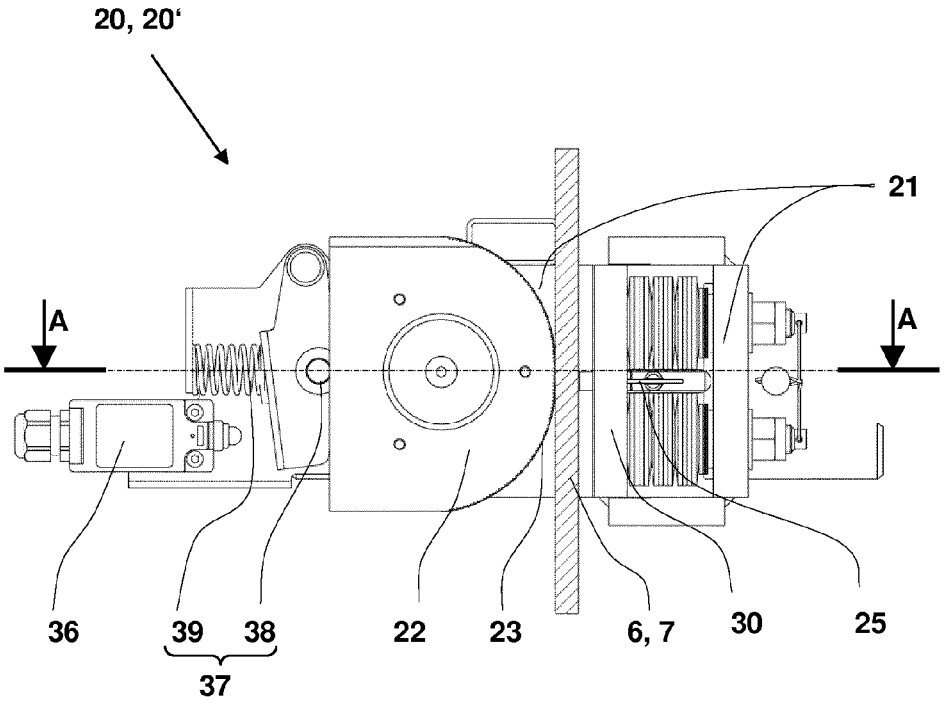
FIG. 6 shows a view of an elevator braking device in an actuated setting.
Figure 6A:
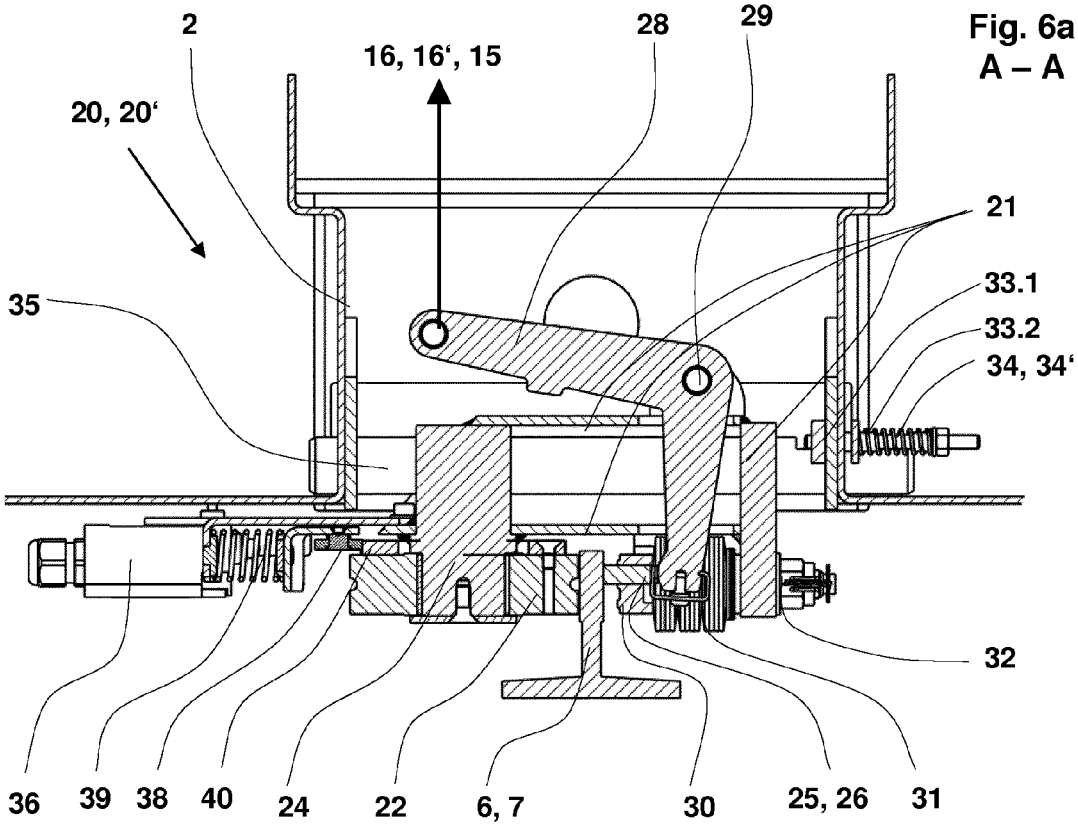
FIG. 6*a* shows a sectional illustration of the elevator braking device of FIG. 6.

In FIGS. 5 and 5*a* the elevator braking device 20 is actuated. The actuator 15 pulls the pressing lever 28 by way of the connecting rod 16. The pressing lever 28 correspondingly pivots about the fulcrum 29 and adjusts the stud 26 relative to the braking web 7. The adjustment of the presser 25, or the stud 26, takes place substantially perpendicularly to the braking web 7. Essentially this means that, for example, due to possible pivot radii of the pressing lever 28 slightly curved forms of movement can be given. The stud 26 projects beyond the brake surface of the second brake body 30 or the brake part 30.1. In the further sequence, according to the mode of operation illustrated in FIGS. 6 and 6*a* the actuator 15 continues to pull and the stud 26 is pressed further forward. Due to the reaction force acting on the brake housing, the brake housing is laterally displaced relative to the centering device 34 in that the abutment 33.2 urges the centering spring 34' back. The first brake body 22 is adjusted towards the braking web 7 by the brake housing and the straining eccentric 23 of the first brake body 22 comes into frictional or entraining contact with the braking web 7. According to experience, the contact force for pressing the straining eccentric 23 against the braking web 7 is to be approximately 600 Newtons. This is an approximate value which can vary in dependence on materials used.

Figure 7:
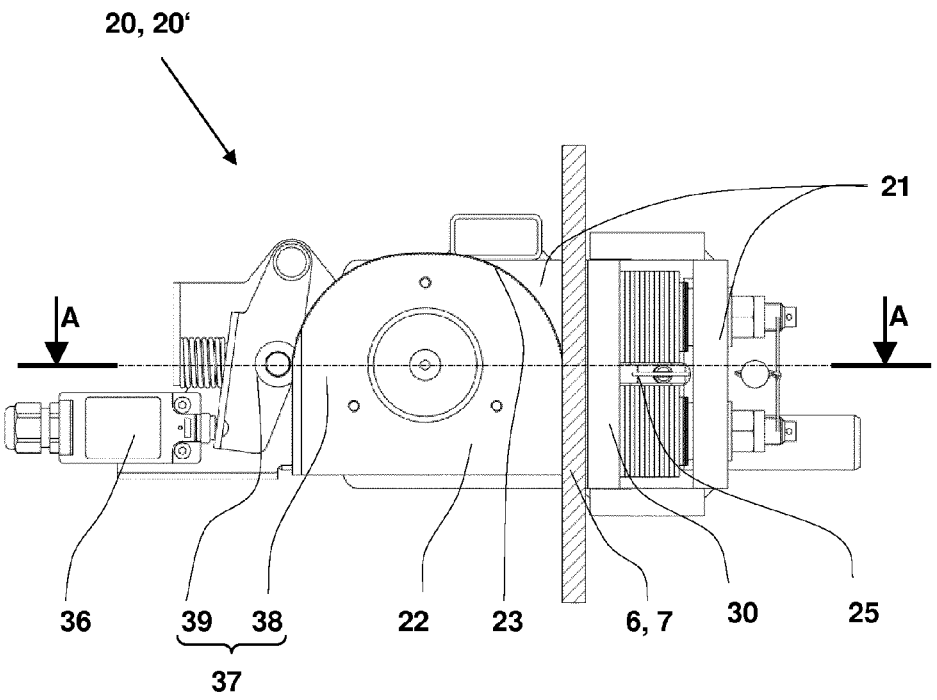
FIG. 7 shows a view of an elevator braking device in a braking setting.
Figure 7A:
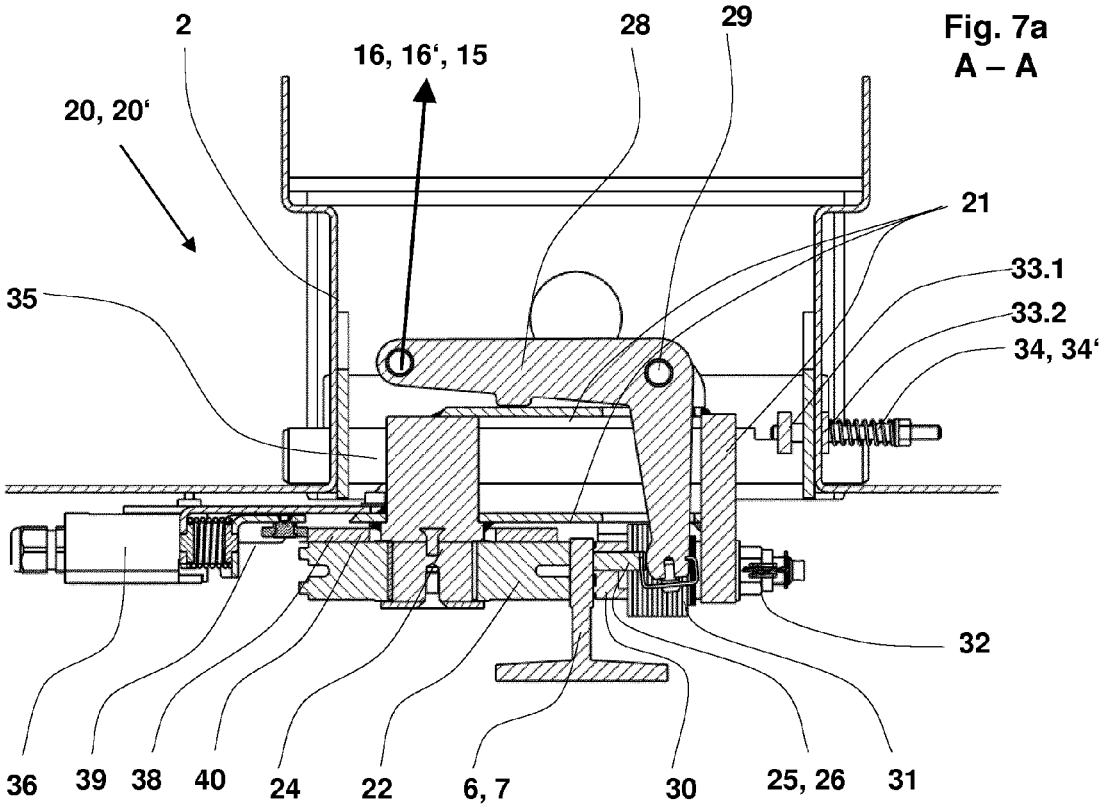
FIG. 7*a* shows a sectional illustration of the elevator braking device of FIG. 7.

Insofar as a vertical relative movement between elevator braking device 20 and braking web 7 takes place the straining eccentric 23 or the first brake body 22 is rotated on the axis 24 of rotation until the straining eccentric 23 reaches its brake surface. This braking setting is apparent in FIGS. 7 and 7*a*. Due to the enlargement of spacing, which is connected with the rotation, of the straining eccentric from the axis of rotation the brake housing 21 is urged back, whereby the stud 26 together with the pressing lever 28 is moved back into a position approximately corresponding with the normal setting. At the same time, the second brake body 30 is similarly pressed and the pressing element 31 of the second brake body 30 is strained. Due to this pressing and straining a build-up of a corresponding braking force relative to the braking web takes place in the second brake body. Urging back of the brake housing 21 is again made possible by the centering device 34 in that now the abutment 33.1 compresses the centering spring 34'.

The afore-mentioned setting back of the stud 26 behind a brake surface of the second brake body 30 in the normal setting makes it possible for the second brake body 30 or the pressure element 31 to be able to be pressed during braking.

The resetting cam 40 of the straining eccentric 23 is also rotated as a consequence of the rotation of the straining eccentric 23, whereby the roller tappet 38 is urged back and the sensor 36 is actuated. As a result, the elevator control can interrupt further travel operation of the elevator installation. A time point or switching instant of the sensor 36 can be determined by the shape of the resetting cam 40 as well as the arrangement of the sensor 36. As a rule, the switching instant of the sensor 36 is selected or set in such a manner that only a clear rotation of the straining eccentric 23 leads to switching of the sensor 36. Faulty switching, for example as a consequence of a brief rail contact, is thereby avoided.

In that regard it is apparent that the rotation of the straining eccentric 23 or of the first brake body 22 takes place in correspondence with the vertical relative movement or the travel direction of the elevator braking device 20. This elevator braking device 20 can be actuated in both directions of travel in the case of appropriate design of the brake body 22.

For resetting of the elevator braking device the car 2 can now be moved in an opposite direction, whereby the straining eccentric 23 is urged back until the normal setting, as illustrated in FIGS. 4 and 4*a*, is reached again.

Figure 8:
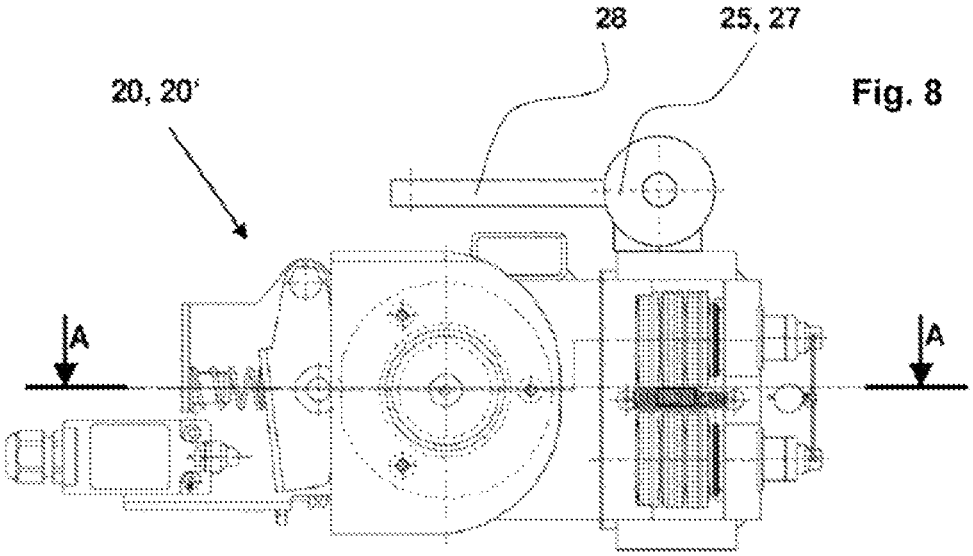
FIG. 8 shows an alternative embodiment of an elevator braking device and FIG. 8*a* shows a sectional view of the elevator braking device of FIG. 8.
Figure 8A:
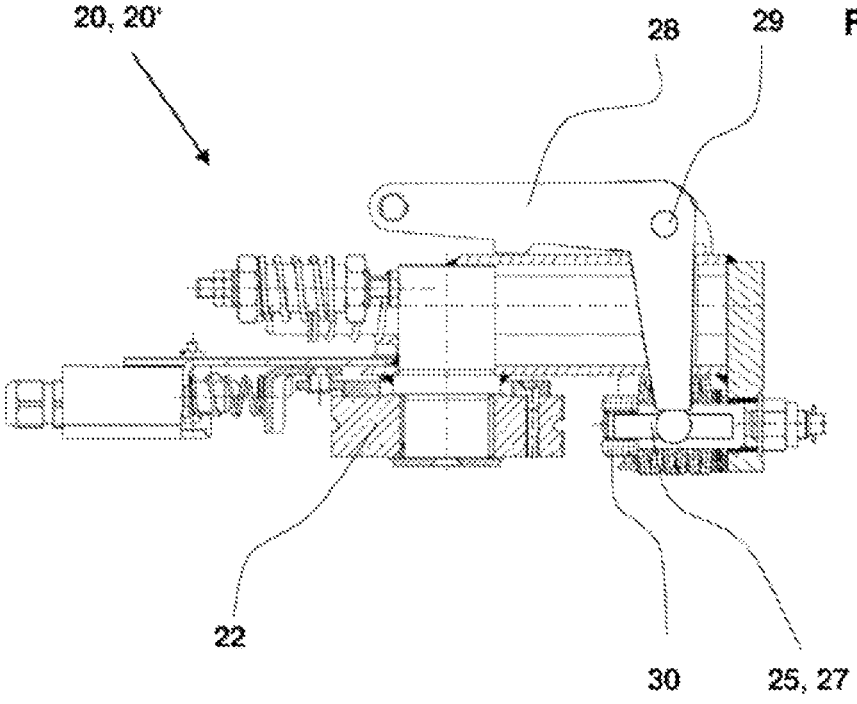

An alternative embodiment is illustrated in FIGS. 8 and 8*a*. In this case the stud 26 of the previous example is replaced by a pressing roller 27. The pressing roller is installed above the brake body at the brake housing, in which case in this example as well actuation takes place by way of the pressing lever 28, which now adjusts the pressing roller 27 instead of the stud 26. The overall functionality of this solution otherwise corresponds with the embodiments explained in the example of FIGS. 4 to 7.

Alternative embodiments are possible. Thus, the stud 26 according to FIGS. 4 to 7 can be eliminated and the pressing lever can act directly on the second brake body. The pressure elements 31 are in that case guided, for example, by a stop pin 32, which enables adjustment of the brake body 30 and which when urged back comes into contact with an abutment in order to then correspondingly build up a pressing force. Alternatively, the presser 25—be it a stud 26, pressing roller 27 or also directly a brake body—can also be adjusted relative to the braking web by other elements, such as, for example, pneumatically.

A straining wedge or a straining roller can also be used instead of the illustrated first brake body in the form of a straining eccentric. In this case, a straining or braking wedge or correspondingly a straining roller is moved along an inclined draw-in path and an adjusting movement is produced by the draw-in path.

The illustrated embodiments and sequences can be further varied by the expert. The substantially symmetrical shape of the straining eccentric as apparent in FIGS. 4 to 8 enables use of the elevator braking device in both travel directions or, instead of the central actuator 15 shown in FIG. 3, individual actuators associated with the elevator braking devices can also be used.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. A braking device for braking an elevator car on a braking web, the braking device comprising:

a brake housing:

a first brake body arranged at the brake housing and movable relative to the brake housing by contact with the braking web and movement of the brake housing along the braking web to clamp the braking web and apply strain to the brake housing; and a presser arranged at the brake housing to position the braking web between the first brake body and the presser, wherein in a normal setting of the braking device there is a first spacing between the first brake body and the presser at least corresponding with a thickness of the braking web plus a predetermined passage tolerance between the first brake body, the braking web and the presser, wherein the presser is adjustable toward the first brake body for pressing the presser and the first brake body against the braking web, wherein the presser is a stud mounted at the brake housing and the stud is adjustable towards the braking web or the presser is a pressing roller mounted at the brake housing and the pressing roller is adjustable towards the braking web, wherein the first brake body is brought into contact with the braking web by a counterforce acting on the braking web when the presser is pressing against the braking web, and wherein the braking device further includes a pressing lever pivotably mounted at the brake housing and acting on the presser to press the presser against the braking web to thereby displace the brake housing and bring the first brake body into contact with the braking web.

2. The braking device according to claim 1 wherein the first brake body includes a straining eccentric rotatable about an axis of rotation arranged at the brake housing, and wherein when the straining eccentric is pressed against the braking web the straining eccentric is rotated by the relative movement and a friction force produced between the straining eccentric and the braking web, whereby the brake housing is urged back toward the normal setting of the braking device and strained.

3. The braking device according to claim 2 wherein the straining eccentric is centered by a resetting device in the normal setting and at least one of departure of the straining eccentric from the normal setting, attainment of a clamping setting, or attainment of a braking setting is detected by a sensor.

4. The braking device according to claim 3 wherein the sensor detects a position of the resetting device to determine departure from the normal setting or attainment of the clamping setting or attainment of the braking setting.

5. An elevator installation with the braking device according to claim 1 wherein the braking device is fastened to an elevator car by a horizontal slide device and a centering device.

6. The elevator installation according to claim 5 wherein the presser is pressed against the braking web by an actuator.

7. The elevator installation according to claim 5 wherein the elevator car is equipped with two of the braking device, each of the two braking devices acting on an associated one of two braking webs arranged on opposite sides of the elevator car.

8. The braking device according to claim 1 including a second brake body arranged at the brake housing wherein the braking web is positioned between the first brake body and the second brake body whereby the strain applied by the first brake body on the brake housing clamps the braking web between the first and second brake bodies.

9. The braking device according to claim 1 wherein the presser is constructed as a second brake body mounted in the brake housing by stop pins and supported relative to the brake housing by pressure elements and wherein the second brake body is adjustable relative to the braking web.

10. The braking device according to claim 1 wherein the pressing lever is connected to the presser for adjusting the presser relative to the braking web.

11. A braking device for braking an elevator car on a braking web, the braking device comprising:

a brake housing:

a first brake body arranged at the brake housing and movable by contact with the braking web and relative movement between the braking web and the brake housing to clamp at the braking web and apply strain to the brake housing; and a presser arranged at the brake housing to position the braking web between the first brake body and the presser, wherein in a normal setting of the braking device there is a first spacing between the first brake body and the presser at least corresponding with a thickness of the braking web plus a predetermined passage tolerance between the first brake body, the braking web and the presser, wherein the presser is adjustable toward the first brake body for pressing against the braking web, wherein the first brake body is brought into contact with the braking web by a counterforce acting on the braking web when the presser is pressing against the braking web, wherein the braking device further includes a pressing lever pivotably mounted at the brake housing and acting on the presser to press the presser against the braking web to thereby displace the brake housing and bring the first brake body into contact with the braking web, wherein the first brake body includes a straining eccentric rotatable about an axis of rotation arranged at the brake housing, and wherein when the straining eccentric is pressed against the braking web the straining eccentric is rotated by the relative movement and a friction force produced between the straining eccentric and the braking web, whereby the brake housing is urged back toward the normal setting and strained.

12. The braking device according to claim 11 wherein the straining eccentric is centered by a resetting device in the normal setting and at least one of departure of the straining eccentric from the normal setting, attainment of a clamping setting, or attainment of a braking setting is detected by a sensor.

13. The braking device according to claim 12 wherein the sensor detects a position of the resetting device to determine departure from the normal setting or attainment of the clamping setting or attainment of the braking setting.

* * * * *